US007406726B2

(12) United States Patent
Deng

(10) Patent No.: US 7,406,726 B2
(45) Date of Patent: Aug. 5, 2008

(54) FOLDING HAMMOCK STAND OR FRAME

(76) Inventor: Jianrong Deng, Bihuge Xingcheng Shaminan Huanggi Dist., Nanhai City, Guang Dong Province (CN) 528248

( * ) Notice: Subject to any disclaimer, the term of this patent is extended or adjusted under 35 U.S.C. 154(b) by 73 days.

(21) Appl. No.: 11/439,400

(22) Filed: May 24, 2006

(65) Prior Publication Data

US 2006/0282948 A1 Dec. 21, 2006

(30) Foreign Application Priority Data

Jun. 16, 2005 (CN) ..... 2005 2 0059944

(51) Int. Cl.
*A45F 3/24* (2006.01)
*A47C 17/64* (2006.01)
*A47C 17/70* (2006.01)

(52) U.S. Cl. ..... 5/127; 5/129; 5/115; 5/116

(58) Field of Classification Search ..... 5/127, 5/129, 115, 175, 182, 181, 174, 114, 116, 5/117
See application file for complete search history.

(56) References Cited

U.S. PATENT DOCUMENTS 37,153 A * 12/1862 Cross ..... 5/115
2,581,623 A * 1/1952 Benjamin ..... 5/129

* cited by examiner

*Primary Examiner*—Patricia Engle
*Assistant Examiner*—Jonathan J Liu
(74) *Attorney, Agent, or Firm*—Charles I. Brodsky

(57) ABSTRACT

Four cross member struts, two on each long side of an open hammock frame, permit full collapse of the frame for closure and transportation when the cross member struts are composed of an unbroken tube pivotally connected with a second tube divided into two overlapping sections.

10 Claims, 3 Drawing Sheets

10

FOLDING HAMMOCK STAND OR FRAME

CROSS-REFERENCE TO RELATED APPLICATIONS

This is a Continuation of Application No. China 200520059944.2, filed Jun. 16, 2005.

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to hammocks, in general, and to a collapsible, easily portable folding hammock stand or frame for outdoor use, in particular.

2. Description of the Related Art

Because of the recreational popularity of hammocks, collapsible hammock support structures have been suggested for holding a hammock in its opened position. One disadvantage of those that are available is that they are complex in construction and difficult to set up for use and later collapse. A second disadvantage is that they are hard to transport from place to place due to their weight and bulkiness.

SUMMARY OF THE INVENTION

As will become clear from the following description, the folding hammock stand or frame of the present invention overcomes these disadvantages—and, through the use of four special "X" cross member struts appropriately pivot connected at prescribed locations so that the structure, when pushed to close, will fold the four "Xs", flipping them together in overlapping relationship. As will be seen, the overlapping "Xs" include a pivot connection where they meet midway, and with the ends of the member struts then connected and riveted to other members. As will be understood by those skilled in the art, if the folding hammock stand or frame were constructed otherwise, not only would the frame not close, but the frame could not be folded upwards—locking, instead, at ¼ of the way.

In accordance with the teachings of the invention, the folding hammock stand or frame is fabricated with four such special "Xs", two on each longside of the frame. Each "X" is composed of two tubes, one of which is further divided into two sections; with an overlapping "drill hole" in each section, a pin is inserted through the hole to allow the full collapse to take place and to put back the rigidity to that "X" when the stand or frame is opened.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
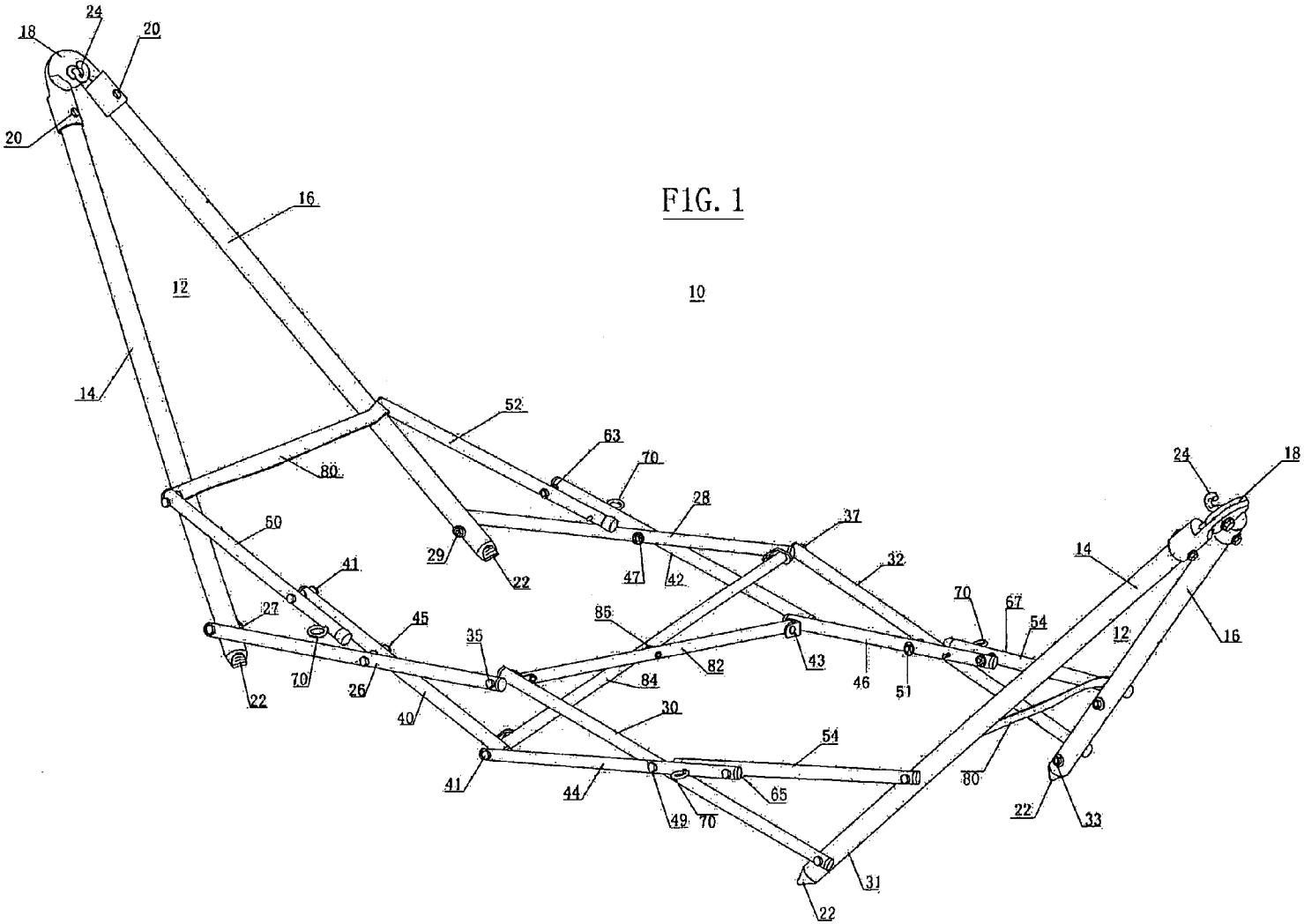
FIG. 1 is a pictorial view of the folding hammock stand or frame of the invention in its open position, ready to receive a recreation hammock to rest upon.

The folding hammock stand or frame of the invention 10 includes a pair of end frames 12, each having first and second stand up legs 14, 16. A post connector 18 joins each of the legs 14, 16 at one end, pivoted as at 20, and with cushioning feet 22 inserted at the opposite ends of the frame legs. A hook for the hammock bed to be installed is shown at 24.

First, second, third and fourth metallic members, struts or tubes are provided, each having a first end pivotally connected to a to a lower end of one of the first and second legs 14, 16 of the end frames 12. Such tubes are shown at 26, 28, 30 and 32 connected as at 27, 29, 31 and 33 respectively. As more particularly shown in FIG. 1, the second opposite end of the tubes 26, 28, 30 and 32 are similarly pivotally connected—the tube 26 with the tube 30 at the connection 35, and the tube 28 with the tube 32 at the connection 37. As will be appreciated, each of the tubes 26, 28, 30 and 32 are thus provided with apertures adjacent their respective opposite ends to receive the pivot connections, preferably in the form of rivets. As will become clear from the following description, furthermore, each of these tubes 26, 28, 30 and 32 are provided with yet another aperture to receive pivot connections, substantially midway between their opposite ends.

Four additional metallic tubes are provided 40, 42, 44 and 46. Such tubes are also provided with multiple apertures—one for pivotally connecting the lower ends of the tubes 40 and 44 at a pivot L-connection 41 and for joining the lower ends of the legs 42 and 46 at a pivot L-connection 43—a second for joining the tube 26 with the tube 40 at a midway pivot connection 45, for joining the tubes 28 and 42 at a midway pivot connection 47, for joining the tubes 30 and 44 at a midway pivot connection 49, and for joining the tubes 32 and 46 at a midway pivot connection 51. Rivets may similarly be used to pivotally connect the tubes 26 & 40, 28 & 42, 30 & 44 and 32 & 46 in this manner.

Four further metallic tubes are provided 50, 52, 54 and 56, each also with multiple apertures—one for pivotally connecting the upper end of the tube 40 with the tube 50 at a pivot connection 61, for joining the upper end of the tube 42 with the tube 52 at a pivot connection 63, for joining the upper end of the tube 44 with the tube 54 at a pivot connection 65, and for joining the upper end of the tube 46 with the tube 56 at a pivot connection 67. As before, rivets may be used to pivotally connect these tubes 40 & 50, 42 & 52, 44 & 54 and 46 & 56. A fourth aperture is provided in each of the legs 40, 42, 44 and 46 to afford the upwards folding of the hammock stand or frame for transportation or storage and collapse to the closure position of FIG. 3.

More specifically, as FIG. 1 illustrates, the tubes 50 and 52 respectively pivotally connect with the tubes 40 and 42 by the rivet connections through the third apertures on the tubes 40 and 42, at 61 and 63. Similarly, the tube 44 pivotally connects with the tube 54 while the tubes 46 and 56 pivotally connect, at 65 and 67, also through the third aperture on the tubes 44, 46. On the tubes 40, 42, 44 and 46, however, there is yet a fourth aperture while on the tubes 50, 52. 54 and 56 there is yet a second aperture.

Figure 2:
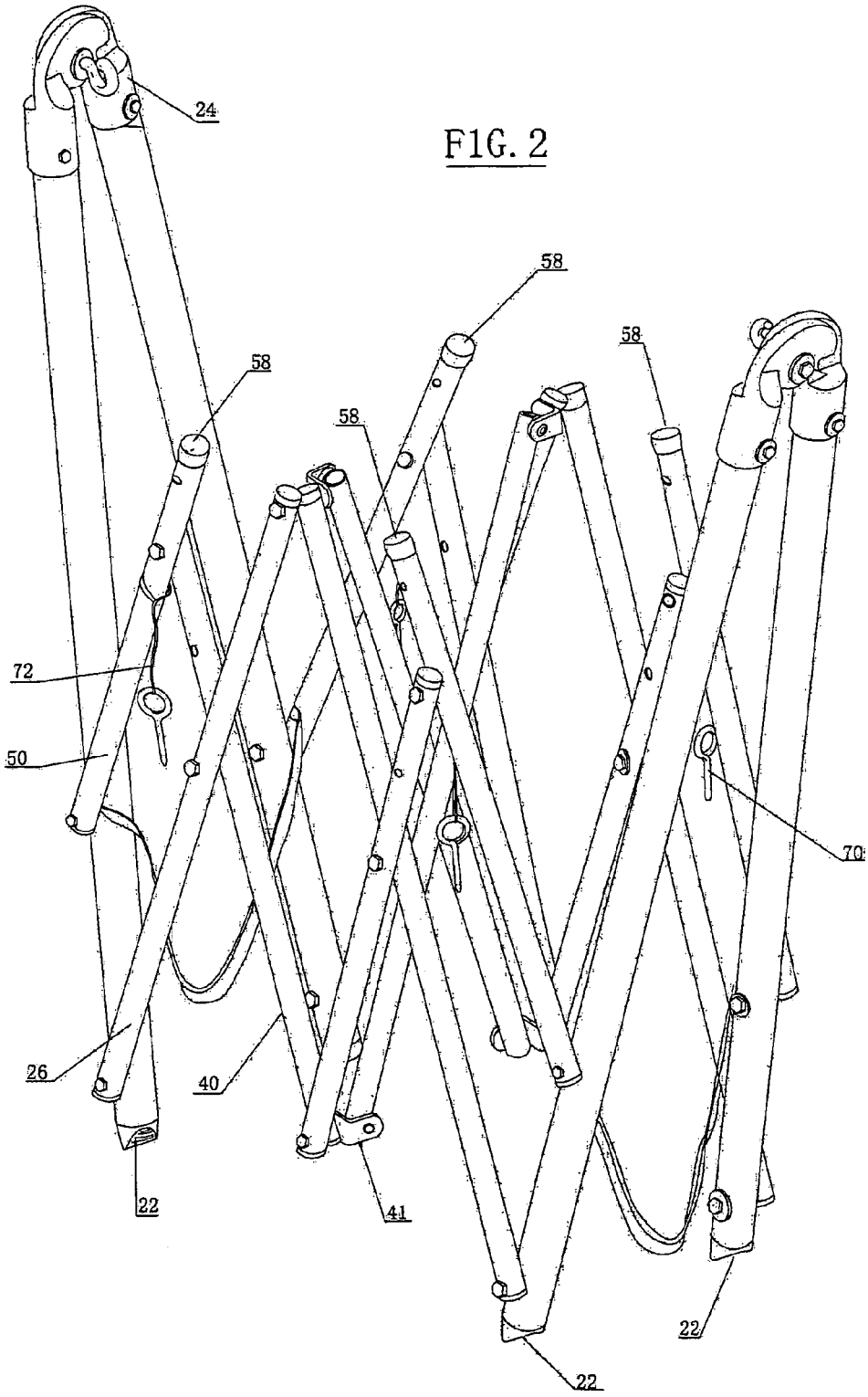
FIG. 2 illustrates a closing of the hammock stand from its FIG. 1 set up.

In accordance with the teachings of the invention, for the hammock stand or frame 10 to fold, the four "X" crossings (two on each of the longside of the frame 10) are broken into two sections by the tubes 40/50, 42/52, 44/54 and 46/56. Furthermore, as FIG. 1 illustrates, the orientation of these special "X" crossings is for the tube 40 to fit inwardly of the tube 50, the tube 42 to reside outwardly of the tube 52, the tube 44 to reside outwardly of the tube 54, and the tube 46 to reside inwardly of the tube 56. A pint 70 hanging from a line 72 (FIG. 2) is configured to lock the hammock into its open position by passing through a second aperture adjacent the lower end of the tube 50 into the fourth aperture of the tube 40 with the pins being inserted similarly through the fourth aperture of the tube 42 into a second aperture at the lower end of the tube 52, through the fourth aperture of the tube 44 into a second aperture at the lower end of the tube 54, and through a second aperture at the lower end of the tube 56 into the fourth aperture of the tube 46. Pulling of the pins 70 unlocks the securement in allowing the end frames 12 to be rotated towards one another, pulling the "X" crossed legs with them through the pivot connections. Straps 80 join with yet another, third aperture at the upper ends of the tubes 50, 52 on the one hand, and of 54, 56 on the other hand, along with pivot connections on the stand up legs 14, 16 to provide support for the hammock bed when hooked into position. Cushioning feet 58 are inserted at the lower ends of the tubes 50, 52, 54 and 56 (FIG. 2).

To complete the construction, two additional tubes 82 and 84 are utilized. The tube 84, as shown, joins with the pivot L-connection 41 of the tubes 40, 44 at one end, and with the pivot connection 37 of the tubes 28, 32 at the other end. The tube 82, on the other hand, joins the pivot connection 35 of the tubes 26, 30 with the pivot L-connection 43 of the tubes 42, 46. As indicated at 85, the tubes 82, 84 are pivotally connected together midway along their respective lengths.

Figure 3:
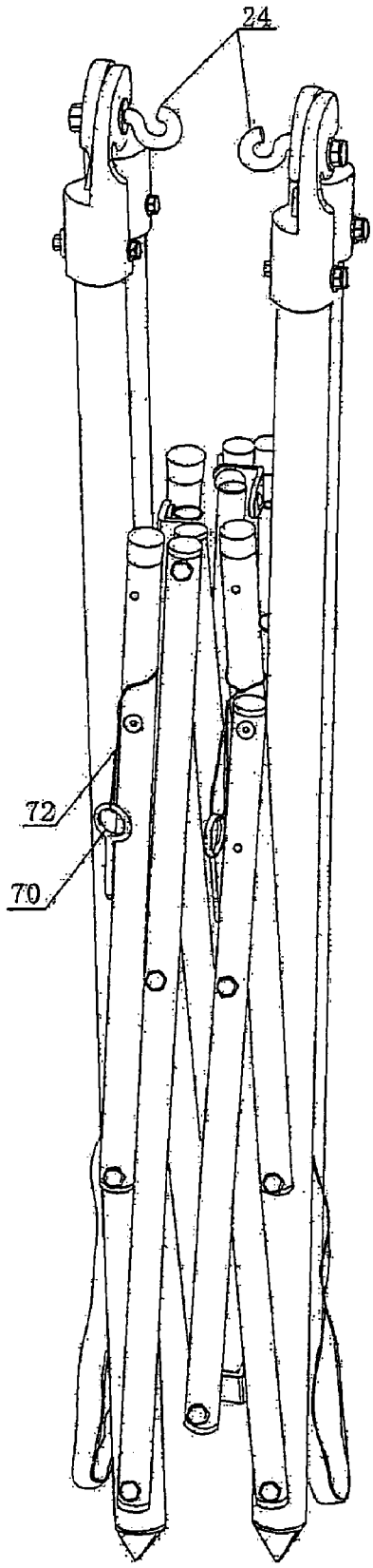
FIG. 3 is an illustration of the end result of the closing of FIG. 2, with the hammock stand or frame totally collapsed.

As will be appreciated, the overlapping tubes 40 & 50, 42 & 52, 44 & 54 and 46 & 56 may be considered as one tube each, broken into two sections—which however are extensions of each other due to the inclusion of the extra pivot connection to hold each two-section portion together. With the special "X" construction of one complete tube and its criss-crossing tube partner broken into two parts (as at 26 and 40-50; at 28 and 42-52; at 30 and 44-54; and at 32 and 46-56), one pivot connection joins the unbroken tube to one section of the broken tubes (as at 45, through tubes 26 and 40), and one pivot connection joins the two broken tubes together (as at 61, between the tubes 40 and 50). Because of the two overlying broken sections of the tubes 40 & 50, 42 & 52, 44 & 54 and 46 & 56, a complete, foldable collapsing action results for easy transportation and storage of the hammock stand or frame (FIG. 3).

While there has been described what is considered to be preferred embodiment of the present invention, it will be readily appreciated by those skilled in the art that modifications can be made without departing from the scope of the teachings of the invention. For at least such reason, therefore, resort should be had to the claims appended hereto for a true understanding of the invention.

I claim:

1. A collapsible, foldable hammock comprising:

a pair of end frames (12), each having first (14) and second (16) stand up legs;

first (26), second (28), third (30) and fourth (32) tubes, each having a first end pivotally connected to a lower end of one of said first and second legs of said frames;

first and second straps respectively spanned across said first and second legs of each of said pair of said end frames;

fifth (50), sixth (52), seventh (54) and eighth (56) tubes having a first end pivotally connected to one of said first and second legs of said frames at ends of said straps;

ninth (40) and tenth (44) tubes pivotally connected together at one end at a first point (41);

eleventh (42) and twelfth (46) tubes pivotally connected together at one end at a second point (43);

a thirteenth tube (84) having a first end pivotally connected with said ninth (40) and tenth (44) tubes at said first point (41) and a second end pivotally connected with said second (28) and fourth (32) tubes at a third point (37);

a fourteenth tube (82) having a first end pivotally connected with said eleventh (42) and twelfth (46) tubes at said second point (43) and a second end pivotally connected with said first (26) and third (30) tubes at a fourth point (35);

with said fifth tube (50) overlapping a portion of said ninth tube (40) and pivotally connected therewith, with said eleventh tube (42) overlapping a portion of said sixth tube (52) and pivotally connected therewith, with said tenth tube (44) overlapping a portion of said seventh tube (54) and pivotally connected therewith, and with said eighth tube (56) overlapping a portion of said twelfth tube (46) and pivotally connected therewith;

with said thirteenth tube (84) and said fourteenth tube (82) being pivotally connected midway along the lengths thereof at a fifth point (85);

and with 4 removable pins respectively inserted between said fifth (50) and ninth (40) tubes, between said eleventh (42) and sixth (52) tubes, between said tenth (44) and sixth (54) tubes, and between said eighth (56) and twelfth (46) tubes.

2. The collapsible, foldable hammock of claim 1 wherein said 4 removable pins are respectively inserted from said fifth (50) tube into said ninth (40) tube, from said eleventh (42) tube into said sixth (52) tube, from said tenth (44) tube into said sixth (54) tube, and from said eighth (56) tube into said twelfth (46) tube.

3. The collapsible, foldable hammock of claim 1 wherein said first tube (26) is pivotally connected with said ninth tube (40), wherein said second tube (28) is pivotally connected with said eleventh tube (42), wherein said third tube (30) is pivotally connected with said tenth tube (44), and wherein said fourth tube (32) is pivotally connected with said twelfth tube (46).

4. The collapsible, foldable hammock of claim 1 wherein said first tube (26) is pivotally connected with said ninth tube (40) midway along the lengths thereof, wherein said second tube (23) is pivotally connected with said eleventh tube (42) midway along the lengths thereof, wherein said third, tube (30) is pivotally connected with said tenth tube (44) midway along the lengths thereof, and wherein said fourth tube (32) is pivotally connected with said twelfth tube (46) midway along the lengths thereof.

5. The collapsible, foldable hammock of claim 4 wherein said 4 removable pins are respectively inserted from said fifth (50) tube into said ninth (40) tube, from said eleventh (42) tube into said sixth (52) tube, from said tenth (44) tube into said sixth (54) tube, and from said eighth (56) tube into said twelfth (46) tube.

6. The collapsible, foldable hammock of claim 5, including 4 cushioned feet at a bottom end respectively of each of said end frame legs.

7. The collapsible, foldable hammock of claim 6, including 4 cushioned feet at the ends respectively of said fifth (50), sixth (52), seventh (54) and eighth (56) tubes remote front their respective pivot connections with said first and second stand-up legs of said end frames.

8. The collapsible, foldable hammock of claim 7 including an L-connector at each of said first (41) and second (43) points.

9. The collapsible, foldable hammock of claim 8 wherein all of said tubes are of a metallic composition.

10. The collapsible, foldable hammock of claim 9 employing rivets for establishing each pivot connection.

* * * * *